United States Patent [19]

Draper

[11] 3,962,596

[45] June 8, 1976

[54] FILAMENT SHIELDS

[75] Inventor: Geoffrey Roland Draper, Kettering, England

[73] Assignee: British Sealed Beams Limited, Corby, England

[22] Filed: Nov. 4, 1974

[21] Appl. No.: 520,785

[30] Foreign Application Priority Data

Nov. 14, 1973 United Kingdom..... 52867/73

[52] U.S. Cl...... 313/117; 313/239; 313/333

[51] Int. Cl.[2]..... H01K 1/26; H01K 1/18; H01K 7/02

[58] Field of Search..... 313/113–115, 313/117, 272, 273, 333, 222, 239, 315, 316; 240/41.25, 41 SB, 41 SC, 41.35 R

[56] References Cited

UNITED STATES PATENTS

| | | | |
|---|---|---|---|
| 2,020,130 | 11/1935 | Astor | 313/114 X |
| 2,869,011 | 1/1959 | Verbeek | 313/113 |
| 3,206,595 | 9/1965 | Lollert | 313/113 X |
| 3,646,385 | 2/1972 | Wichert | 313/114 X |

FOREIGN PATENTS OR APPLICATIONS

| | | | |
|---|---|---|---|
| 1,263,086 | 4/1961 | France | 313/115 |

*Primary Examiner*—Siegfried H. Grimm
*Attorney, Agent, or Firm*—Finnegan, Henderson, Farabow & Garrett

[57] ABSTRACT

A filament shield comprising a body with a recess therein. The recess has a base, which may be planar and from which the filament to be shielded is spaced, and is bounded on two opposed edges by a pair of surfaces. Each of these surfaces has a linear inner edge inclined with respect to an axis along which the filament lies and spaced therefrom, and an outer edge inclined to the axis at a greater angle than the respective inner edge.

A lamp unit comprising a parabolic reflector and a filament shield as defined above, the filament shield being disposed so that the axis of the filament lies on the focal axis of the reflector.

10 Claims, 5 Drawing Figures

FILAMENT SHIELDS

This invention relates to filament shields for parabolic reflector lamp units and is more particularly concerned with a shield unit which provides a sharp cutoff of light.

According to the present invention, there is provided a filament shield for a parabolic reflector lamp unit, comprising a body having a recess therein, said recess having a base from which a filament to be shielded is spaced in use, said recess being bounded on two opposed edges by a pair of surfaces, an inner edge of each surface being linear and disposed at an angle to an axis along which the filament is destined to lie in use, said inner edge of each surface being spaced from said axis, and an outer edge of each surface being inclined at a greater angle to said axis than the respective inner edge.

In one embodiment, the inner edge of each surface is disposed at an angle of substantially 33° to said axis, the inner edge of each surface terminates at its nearest point substantially 1.3 mm from the said axis, and the outer edge of each surface has first and second parts disposed at angles of substantially 42° and substantially 29° respectively to said axis, each of the said first parts terminating at a nearest point from said axis substantially 1.4 mm outwardly of the nearest point to the axis of the respective inner edge, and each said first part merging with the respective second part at a point which lies substantially 5.1 mm from said axis and at which point the second part is nearest to said axis.

In another embodiment, the inner and outer edges of each surface are disposed at angles of substantially 28° and substantially 38.5°, respectively, to said axis, the outer edge of each surface further including an end portion which extends substantially parallel to said axis, said end portion being disposed at the end of the outer edge which lies furthest from the axis.

Preferably, the planar portions are mutually disposed at an angle of substantially 15°.

Preferably also, the base of the recess is planar.

Most advantageously, the intended axis of the filament is disposed substantially 3.4 mm from the base of the recess.

Also according to the present invention, there is provided a lamp unit comprising a parabolic reflector, a filament shield as defined above disposed so that the intended axis of the filament lies on the focal axis of the parabolic reflector.

Where the outer edge of each surface of the filament shield has the first and second parts, the arrangement of the filament shield is such that the second parts of the outer edges of the planar portions lie outwardly of the first parts thereof with respect to the focal point of the parabolic reflector and the filament may be disposed so that its nearest point lies substantially 2mm outwardly of the focal point of the reflector.

An embodiment of the present invention will now be described, by way of example, with reference to the accompanying drawings in which.

Figure 1:
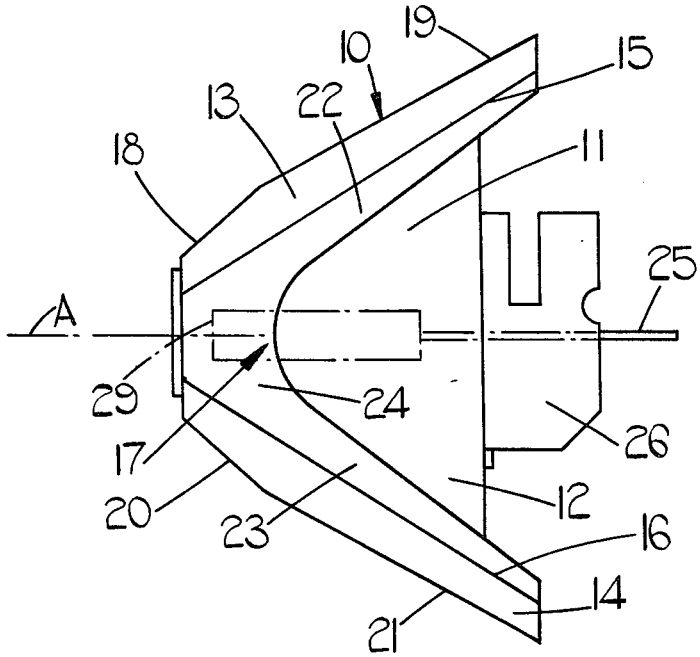
FIG. 1 is a plan view of a filament shield according to the present invention.
Figure 2:
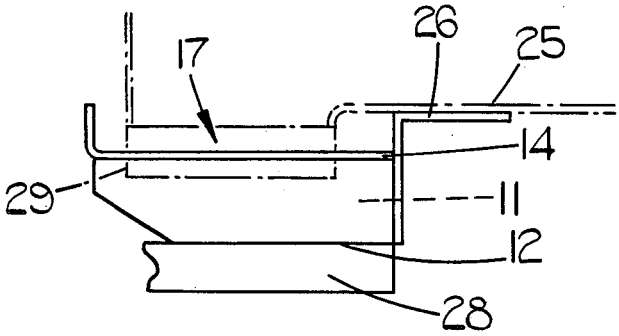
FIG. 2 is a side elevation of the shield of FIG. 1.
Figure 3:
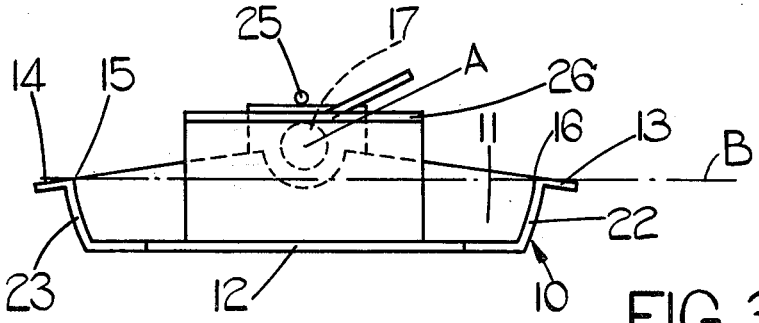
FIG. 3 is an end view of the shield of FIGS. 1 and 2.

Referring to FIGS. 1 to 3, the filament shield comprises a body 10 formed by a pressing operation from a nickel sheet. The body 10 is produced with a recess 11 therein, the recess 11 having a planar base 12. The body 10 also includes a pair of planar surface portions 13 and 14 which abound two opposite edges of the recess 11. Each planar portion 13, 14 has an inner edge 15, 16 respectively which is disposed at an angle of 33° to an axis A on which lies a filament 17. Each planar portion 13, 14 has an outer edge formed of two parts 18 and 19, and 20 and 21, respectively. The outer edge parts 18 and 20 are disposed at an angle of 42° to axis A, whilst the outer edge parts 19 and 21 are disposed at an angle of 29° to axis A. Each inner edge 15, 16 terminates 1.3 mm at its nearest point from axis A. The outer edge parts 18 and 20 terminate 1.4 mm outwardly of the nearest point of the respective inner edges 15 and 16 to axis A. The outer edge parts 18 and 20 merge with their respective outer edge parts 19 and 21 at a point which lies substantially 5.1 mm from axis A. At this point, the outer edge parts 19 and 21 lie at their closest point to the axis A. The planar portions 13 and 14 each span a distance of 12 mm along axis A.

A plane B joining inner edges 15 and 16 passes between axis A and a plane in which base 12 lies (FIG. 3). The planes of portions 13 and 14 are disposed 15° apart. The axis A is spaced 3.4 mm above base 12. The planar portions 13 and 14 are joined to the base 12 through the intermediary of respective, integral curved portions 22 and 23 which smoothly merge with each other at a location 24 towards the narrow end of the filament shield.

The filament 17 is mounted with its axis on axis A and has one lead wire 25 thereof secured to a flange 26 which is integral with the body 10.

Figure 4:
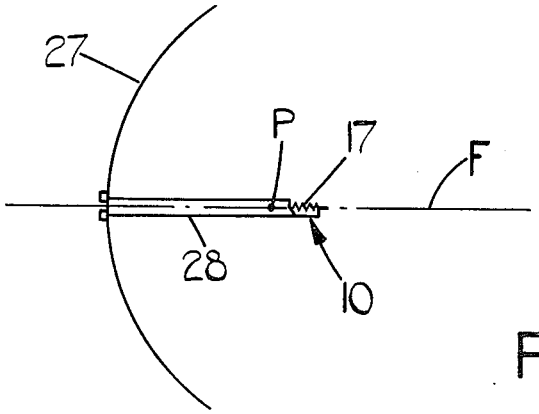
FIG. 4 is a diagrammatic representation of a lamp unit incorporating the shield of FIGS. 1 to 3.

The assembly of shield and filament 17 is mounted in a lamp unit as illustrated schematically in FIG. 4. The lamp unit, which is of the so-called sealed beam type, includes a parabolic reflector 27 having a focal axis F and a focal point P. The shield and filament 17 are mounted in known manner within the lamp unit by means of an electrically conductive support 28 (see FIGS. 2 and 4). The arrangement is such that the axis A lies on focal axis F and the nearest end 29 (see FIGS. 1 and 2) of the filament 17 to the focal point P lies 2 mm from the said point P. The open end of the parabolic reflector 27 is closed by a lens (not shown) in a known manner.

In use, the lamp unit is mounted on a motor vehicle in such a manner that one of the planar portions 13, 14 is horizontally disposed. The light emanating from the lamp unit is sharply cut-off in a horizontal direction and produces superior light intensity characteristics in the projected beam than lamp units employing conventional filament shields.

Figure 5:
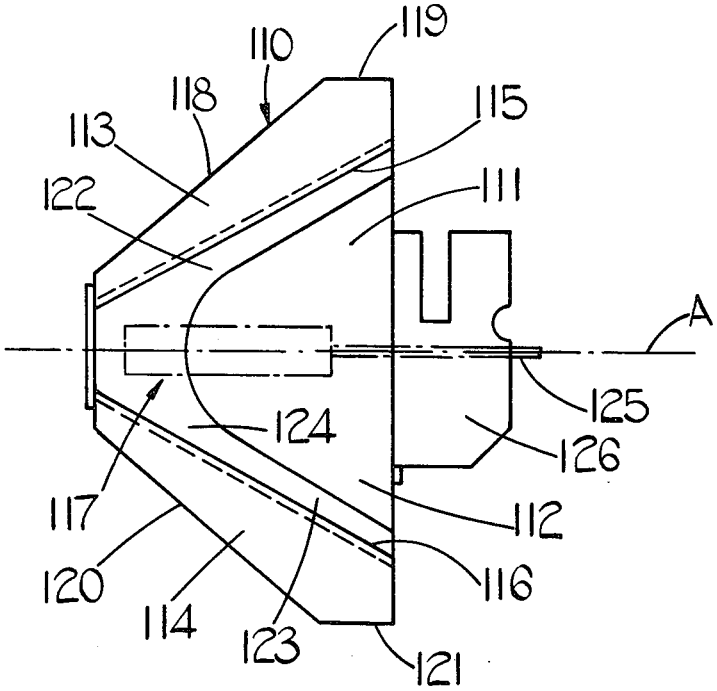
FIG. 5 is a plan view of another form of filament shield according to the present invention.

Referring now to FIG. 5 of the drawings, the filament shield illustrated therein is identical to that illustrated in FIGS. 1 to 3, and similar parts are accorded same reference numerals but prefixed with the reference numeral 1, except that inner edges 115 and 116 are disposed at an angle of 28° to axis A and each span a distance of 11 mm along axis A. Furthermore, outer edge parts 118 and 120 are each disposed at an angle of 38.5° to axis A and extend for the majority of the length of the filament shield, spanning a distance of 7.8 mm along axis A. Outer edge parts 119 and 121 extend parallel to axis A and span a distance of 3.2 mm along axis A. At its nearest point, each of the inner edges 115 and 116 lie 1.3 mm from axis A and at its furthest point lies 7.1 mm from axis A. Outer edge parts 119 and 121 lie 9 mm on either side of axis A. Lastly, the nearest point of outer edge parts 118 and 120 from axis A lie 1.5 mm outwardly of the nearest points of the respective inner edges 115 and 116 from axis A. In use, the filament shield of FIG. 5 operates in much the same way as that described with reference to FIGS. 1, 2 and 3 and can be used in the parabolic reflector lamp unit described in FIG. 4 to replace the filament shield of FIGS. 1 to 3.

It is found that the accuracy with which the filament can be positioned with respect to the focal axis of the parabolic reflector is less critical with a shield of the present invention than with a conventional shield. In fact, extremely good results can be obtained even when the filament axis is not aligned with the focal axis of the parabolic reflector, the criterion being that the focal axis passes through the longitudinal length of the filament. However, the best results are, of course, obtained with the accurate alignment of the filament axis with the focal axis. In contrast, the light intensity characteristics of a beam projected by a lamp unit with a conventional filament shield drop off sharply when the filament axis is not aligned with the focal axis.

Furthermore, the filament shield of the present invention permits good results to be obtained with shorter and wider filaments than has heretofore been considered possible. This enables very real gains to be attained in beam performance by boosting the intensity in the central areas of the beam.

The provision of a planar base shield enables light to be reflected from the underside of the filament so as to provide useful images which reinforce the lower areas of the beam. Furthermore, the use of a planar base presents a good contact area for welding electrodes employed in mounting the filament shield on the conductive support. However, the present invention also contemplates the use of a filament shield according to the present invention provided with a curved base.

I claim:

1. A filament shield for a parabolic reflector lamp unit, comprising a body having a recess therein said recess having a base and receiving, in use, a filament to be shielded so that the filament is spaced from the base, said recess being bounded on two opposed edges by a pair of surfaces, an inner edge of each said surface being linear and disposed at an angle to an axis along which the filament is destined to lie in use, said inner edge of each said surface being spaced from said axis, and an outer edge of each said surface being inclined at a greater angle to said axis than the respective inner edge so that each said surface tapers inwardly toward a focal point of the parabolic reflector lamp unit when said filament shield is mounted in said lamp unit.

2. The filament shield according to claim 1, wherein the inner edge of each surface is disposed at an angle of substantially 33° to said axis, the inner edge of each surface terminates at its nearest point substantially 1.3 mm from the said axis, and the outer edge of each surface has first and second parts disposed at angles of substantially 42° and substantially 29° respectively to said axis, each of the said first parts terminating at a nearest point from said axis substantially 1.4 mm outwardly of the nearest point to the axis of the respective inner edge, and each said first part merging with the respective second part at a point which lies substantially 5.1 mm from said axis and at which point the second part is nearest to said axis.

3. The filament shield according to claim 1, wherein the inner and outer edges of each surface are disposed at angles of substantially 28° and substantially 38.5°, respectively, to said axis, the outer edge of each surface further including an end portion which extends substantially parallel to said axis, said end portion being disposed at the end of the outer edge which lies furthest from the axis.

4. The filament shield according to claim 1, wherein said surfaces are mutually disposed at an angle of substantially 15°.

5. The filament shield according to claim 1, wherein the base of the recess is planar.

6. The filament shield according to claim 1, wherein the intended axis of the filament is disposed substantially 3.4 mm from the base of the recess.

7. A lamp unit comprising a parabolic reflector and the filament shield according to claim 1 disposed so that the intended axis of the filament lies on the focal axis of the parabolic reflector.

8. The lamp unit according to claim 7 wherein the inner edge of each surface is disposed at an angle of substantially 33° to said axis, said inner edge of each said surface terminates at its nearest point substantially 1.3 mm from said axis, and said outer edge of each said surface has first and second parts disposed at angles of substantially 42° and substantially 29° respectively to said axis, each of said first parts terminating at a nearest point from said axis substantially 1.4 mm outwardly of the nearest point to the axis of the respective inner edge, and each said first part merging with the respective second part at a point which lies substantially 5.1 mm from said axis and at which point the second part is nearest to said axis.

9. The lamp unit according to claim 8, wherein said filament shield is disposed so that said filament at its nearest point lies substantially 2 mm outwardly of the focal point of said reflector.

10. The lamp unit according to claim 8, wherein said outer edge of each said surface of said filament shield has first and second parts, and said filament shield is arranged such that said second parts lie outwardly of said first parts with respect to said focal point of said parabolic reflector.

* * * * *